US005628709A

United States Patent [19]

Chen

[11] Patent Number: 5,628,709

[45] Date of Patent: May 13, 1997

[54] EXERCISER WITH COMBINED STEPPING AND TWISTING FUNCTIONS

[76] Inventor: Tsung-Yu Chen, No. 1-9, Ting-Liao, San-Ho Tsuen, Shiu-Shang Hsiang, Chia-Yi Hsien, Taiwan

[21] Appl. No.: 657,276

[22] Filed: Jun. 4, 1996

[51] Int. Cl.[6] ..... A63B 22/14

[52] U.S. Cl. ..... 482/53; 482/146

[58] Field of Search ..... 482/52, 53, 146, 482/147

[56] References Cited

U.S. PATENT DOCUMENTS

| | | | |
|---|---|---|---|
| 2,906,532 | 9/1959 | Echols | 482/146 X |
| 4,629,181 | 12/1986 | Krive | 482/146 X |
| 5,230,675 | 7/1993 | Lin | 482/53 |
| 5,453,065 | 9/1995 | Lien et al. | 482/146 |
| 5,527,253 | 6/1996 | Wilkinson et al. | 482/146 X |
| 5,545,111 | 8/1996 | Wang et al. | 482/53 |

*Primary Examiner*—Stephen R. Crow
*Assistant Examiner*—William LaMarca
*Attorney, Agent, or Firm*—Knobbe, Martens, Olson & Bear, LLP

[57] ABSTRACT

An exerciser with combined stepping and twisting functions is provided. The exerciser includes a base, a tubular sleeve and a stepper. The base has an upright cylindrical body fixed thereto. The cylindrical body is provided with a pair of radially extending and diametrically opposite branches. The tubular sleeve is sleeved rotatably on the cylindrical body and is formed with a circumferentially extending opening to permit passage of the branches on the cylindrical body therethrough. The stepper includes a pair of spaced pedal arms, each of which has a front end pivoted to said tubular sleeve, and a rear end. Each of a pair of resistance cylinders interconnects the rear end of one of the pedal arms and the tubular sleeve. A pair of transmitting members are provided respectively on the front ends of the pedal arms. Each of the transmitting members engages a respective one of the branches on the cylindrical body. When pressure is applied on one of the pedal arms, the pedal arm causes the tubular sleeve to rotate about the cylindrical body, thereby resulting in the combined stepping and twisting functions.

11 Claims, 5 Drawing Sheets

EXERCISER WITH COMBINED STEPPING AND TWISTING FUNCTIONS

BACKGROUND OF THE INVENTION

1. Field of the Invention

The present invention relates to an exerciser, more particularly to an exerciser with combined stepping and twisting functions.

2. Description of the Related Art

Referring to FIG. 1, a conventional exerciser (E) with combined stepping and twisting functions is shown to include a lower stationary support frame 11, which has an upright shaft 111 fixed thereto, and a stepper 12. The stepper 12 includes a base body 121 which is mounted rotatably on the shaft 111 above the stationary support frame 11 and which has an upright front portion 121*a* and a rear portion 121*b*, a pair of spaced pedal arms 124, each of which has a front end 124*a* pivoted to the front portion 121*a* of the base body 121 and a rear end 124*b* extending from the front end 124*a* toward the rear portion 121*b* of the base body 121, and a pair of resistance cylinders 122, each of which interconnects the rear end 124*b* of a respective one of the pedal arms 124 and the base body 121. The stepper 12 is further provided with a pair of hook mounting members 123, each of which extends downwardly from the front end 121*a* of a respective one of the pedal arms 121.

The exerciser (E) further includes a horizontal plate member 13 mounted to the shaft 111 above the base body 121, and means (L) for locking releasably the plate member 13 on the shaft 111 in order to prevent movement of the plate member 13 relative to the stationary support frame 11. The plate member 13 is sleeved rotatably on a top end portion of the shaft 111 and has two opposite spaced rear portions on two sides of the shaft 111. The locking means (L) includes a locking plate 136, which is connected fixedly to the shaft 111 above the plate member 13 by means of a nut 137, and a fastening unit 16 for fastening releasably the plate member 13 to the locking plate 136 so as to lock releasably the plate member 13 to the shaft 111 in order to prevent rotation of the plate member 13 about the shaft 111 with respect to the stationary support frame 11.

A bushing 17 is sleeved around the shaft 111 between the stationary support frame 11 and the plate member 13. The outer wall of the bushing 17 is connected fixedly to the base body 121 of the stepper 12. A pulley 134 is secured axially around the outer wall of the bushing 17 below the plate member 13 and has a rim formed with two annular guiding grooves 134*a*. The plate member 13 has two mounting protrusions 132 and 133, each of which extends downwardly from a respective one of the rear portions of the plate member 13 and has a length corresponding to a vertical distance of a respective one of the annular guiding grooves 134*a* from the plate member 13.

The exerciser (E) further includes two elongated connecting members 14 and 15, each of which has a front end which is connected to a respective one of the hook mounting members 123 on the pedal arms 124, and a rear end passing along a portion of a respective one of the annular guiding grooves 134*a* and connected to the respective one of the mounting protrusions 132 and 133 of the plate member 13.

Therefore, when pressure is applied on one of the pedal arms 123 to cause downward movement thereof, the respective one of the elongated connecting members 14 and 15 pulls the plate member 13 so as to cause rotation of the base body 121 about the shaft 111 relative to the stationary support frame 11.

Although the conventional exerciser (E) is capable of providing two exercising effects at the same time, it still suffers from the following drawbacks. As described in the preceding paragraphs, the conventional exerciser (E) includes a support frame, a stepper, a plate member, a pulley, a bushing sleeved around a shaft and a locking member. Thus, the entire structure is obviously complicated. Moreover, the conventional exerciser (E) is difficult to assemble. Also, the components of the conventional exerciser will easily loosen after long-term operation since only a fastening unit is used to fasten the same together.

SUMMARY OF THE INVENTION

Therefore, the main object of this invention is to provide an exerciser with combined stepping and twisting functions which has a simple and stable construction and which is convenient to assemble.

The exerciser of this invention includes:

- a base having an upright cylindrical body fixed thereto, the cylindrical body being provided with a pair of radially extending and diametrically opposite branches;
- a tubular sleeve sleeved rotatably on the cylindrical body and formed with a circumferentially extending opening to permit passage of said branches on said cylindrical body therethrough; and
- a stepper including: a pair of spaced pedal arms, each of which has a front end pivoted to said tubular sleeve, and a rear end; a pair of resistance cylinders, each of which interconnects said rear end of one of said pedal arms and said tubular sleeve; and a pair of transmitting members provided respectively on said front ends of said pedal arms, each of said transmitting members engaging a respective one of said branches on said cylindrical body.

When pressure is applied to one of the pedal arms, said one of the pedal arms causes the tubular sleeve to rotate about the cylindrical body, thereby resulting in the combined stepping and twisting functions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
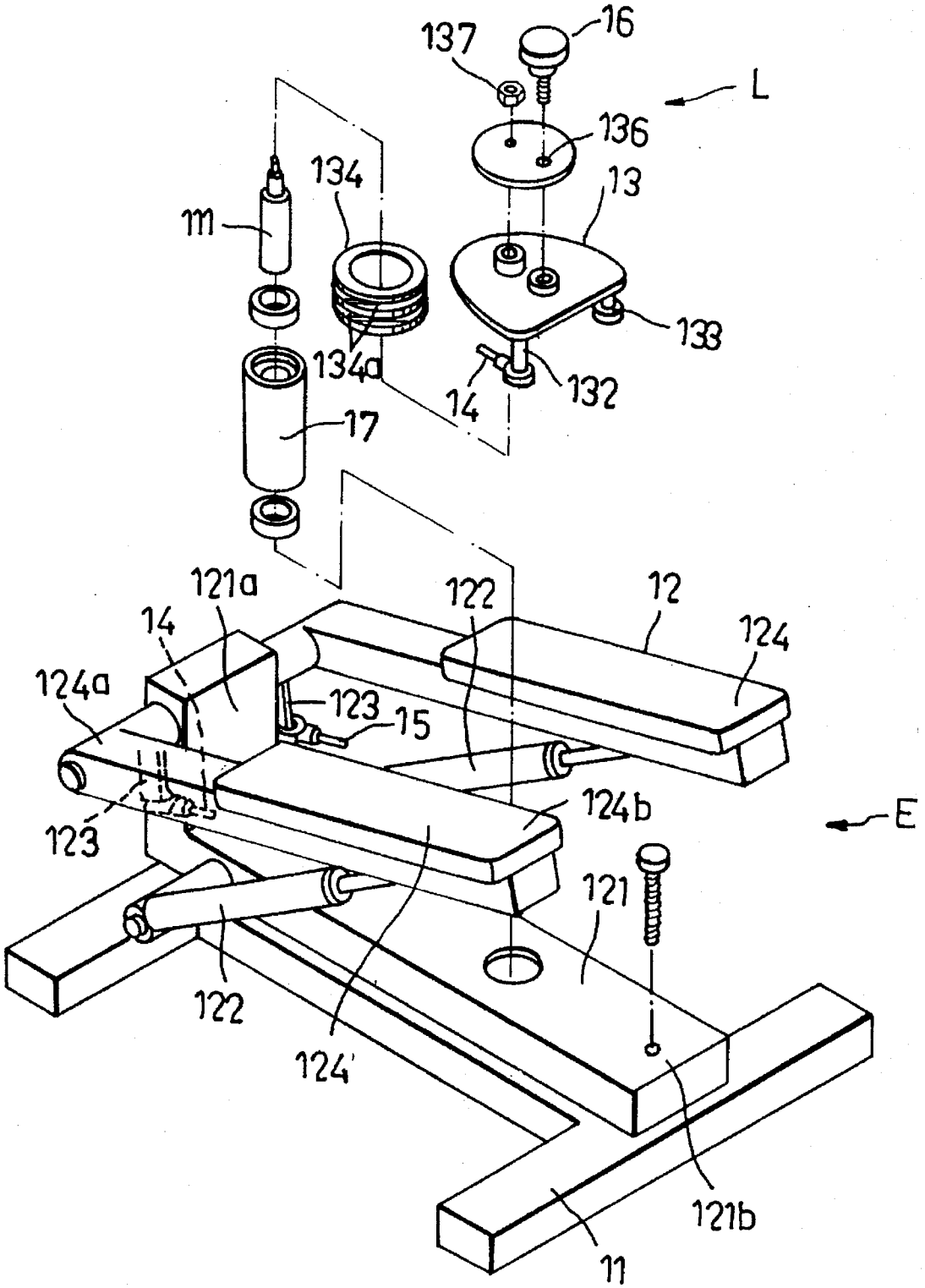
FIG. 1 PRIOR ART
FIG. 1 is an exploded perspective view of a conventional exerciser with combined stepping and twisting functions.
Figure 2:
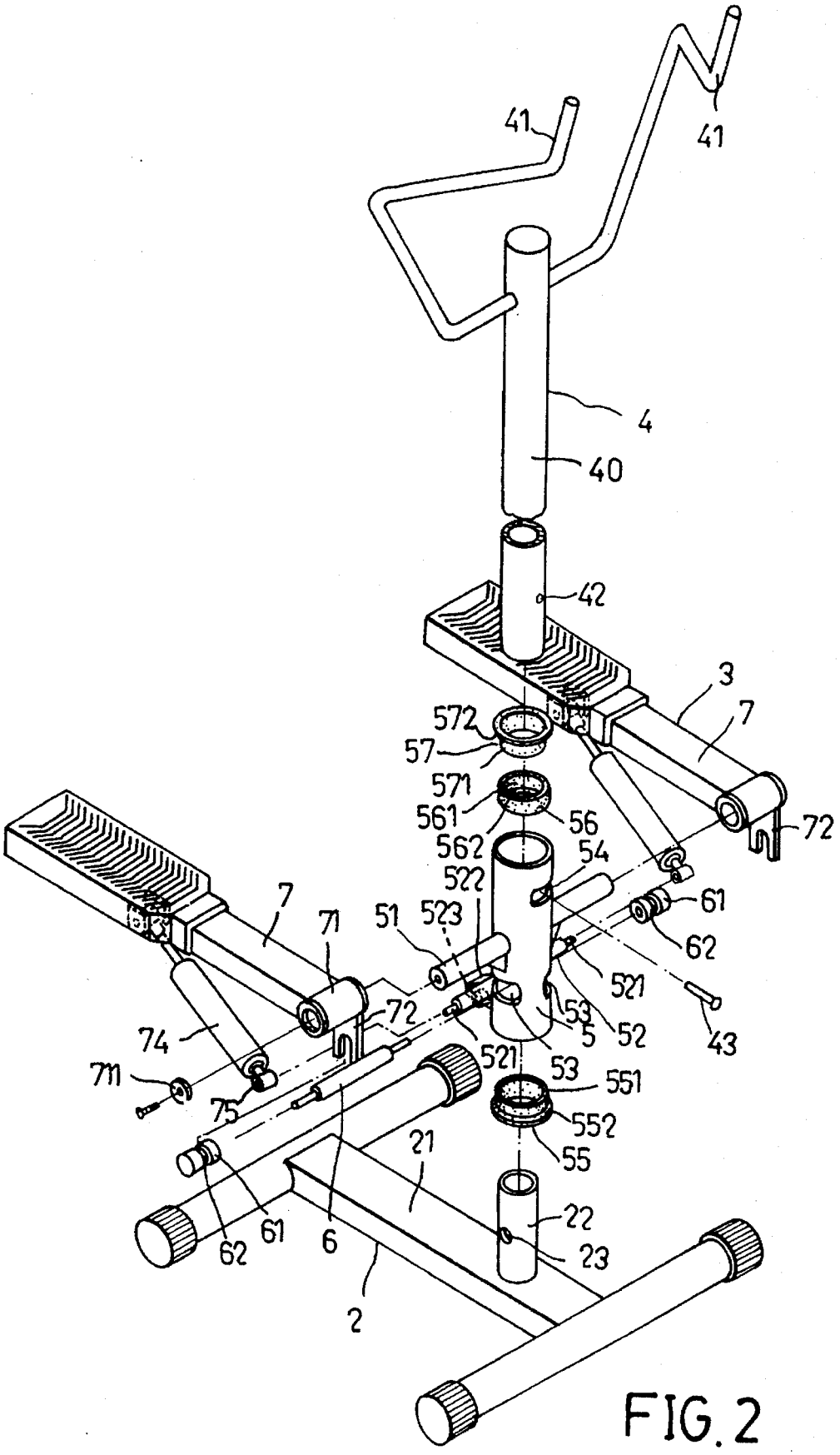
FIG. 2 is an exploded perspective view of a preferred embodiment of the exerciser of this invention.

Referring to FIG. 2, the preferred embodiment of the exerciser of invention is shown to include a support frame 2, a tubular sleeve 5, a stepper 3 and a handle unit 4 which extends into the tubular sleeve 5.

The support frame 2 is generally I-shaped and includes a base 21 having an upright cylindrical body 22 fixed thereto.

The cylindrical body 22 is formed with a diametrically extending through hole 23.

Figure 4:
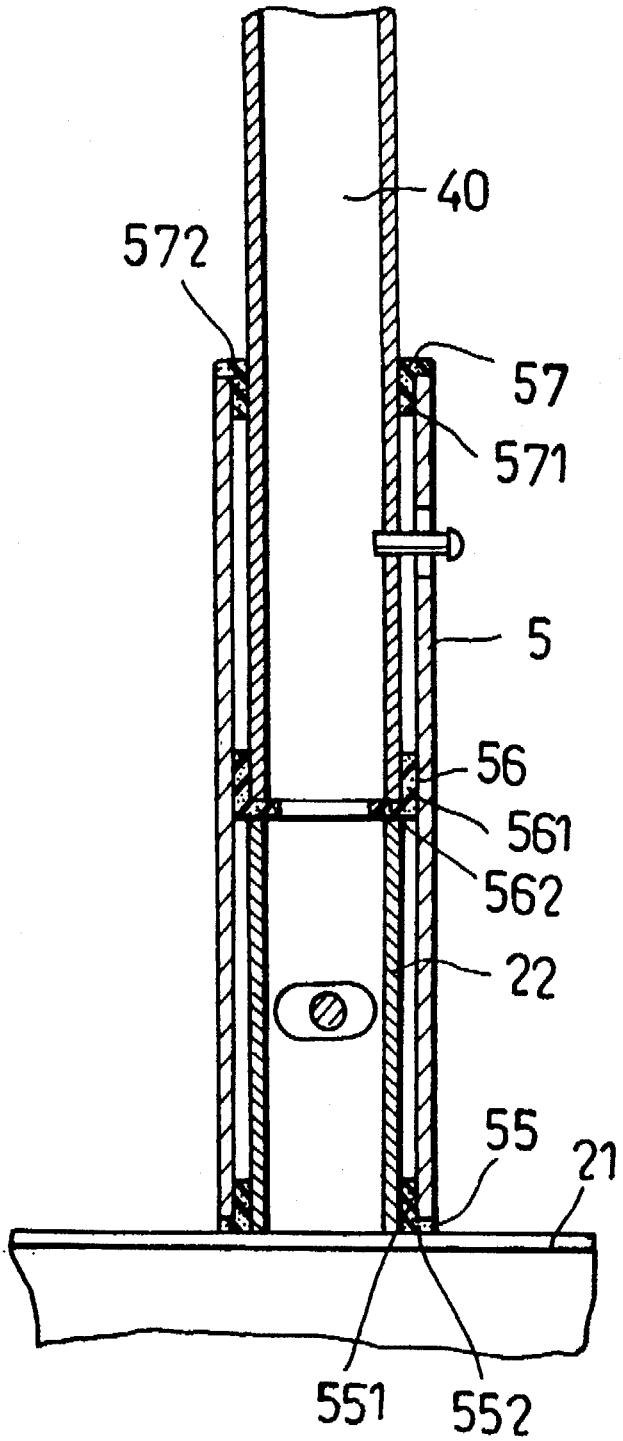
FIG. 4 is a partially cross-sectional view of the preferred embodiment of the exerciser of this invention.
Figure 5:
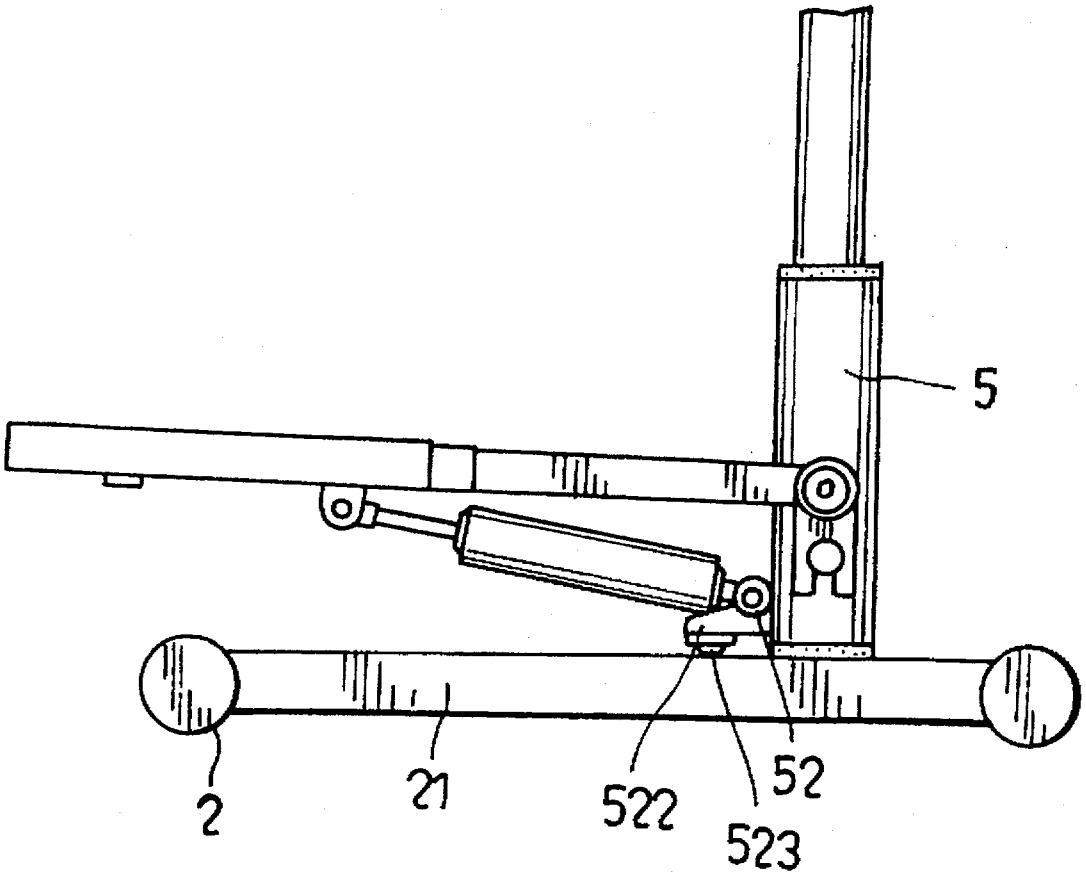
FIG. 5 is a side elevation view of the preferred embodiment of the exerciser of this invention.

The tubular sleeve 5 has a length longer than the cylindrical body 22 and is sleeved rotatably on the cylindrical body 22. The tubular sleeve 5 is formed with a pair of radially extending and diametrically opposite pivot arms 51 and a horizontally disposed mounting rod 52 adjacent to the lower end of the tubular sleeve 5. The mounting rod 52 has two diameter-reduced end portions 521. The mounting rod 52 includes a mounting portion 522 which connects the mounting rod 52 and the tubular sleeve 5. The mounting portion 522 is provided with ball means 523 which is in rolling contact with the base 21 of the support frame 2 to facilitate rotation of the tubular sleeve 5 about the cylindrical body 22 as shown in FIG. 5. The tubular sleeve 5 is formed with a pair of circumferentially extending openings 53 which are symmetric to each other and which are located between the pair of pivot arms 51 and the mounting rod 52. The pair of circumferentially extending openings 53 are registered with the through hole 23. The exerciser further includes a first packing ring 55, a second packing ring 56 and a third packing ring 57, which are preferably made of plastic. Referring to FIG. 4, the first packing ring 55 is sleeved on the cylindrical body 22 and is provided on top of the base 21. The first packing ring 55 has a ring portion 551 between the cylindrical body 22 and the tubular sleeve 5, and a flange portion 552 between the base 21 and the tubular sleeve 5. The tubular sleeve 5 rests on the flange portion 552 of the packing ring 55. The second packing ring 56 is sleeved around the bottom end of a post 40 of the handle unit 4. The second packing ring 56 has a ring portion 561 between the bottom end of the post 40 and the tubular sleeve 5, and a rim portion 562 between the bottom end of the post 40 and the cylindrical body 22. The third packing ring 57 is sleeved around the post 40 and has a ring portion 571 between the post 40 and the tubular sleeve 5, and a flange portion 572 resting on top of the tubular sleeve 5. A shaft 6 passes through the circumferentially extending openings 53 in the tubular sleeve 5 and the through hole 23 in the cylindrical body 22. The shaft 6 has two end portions that serve as radially extending and diametrically opposite branches. Each of the branches is provided with a respective retaining member 61. The retaining member 61 is formed with an annular groove 62.

Figure 3:
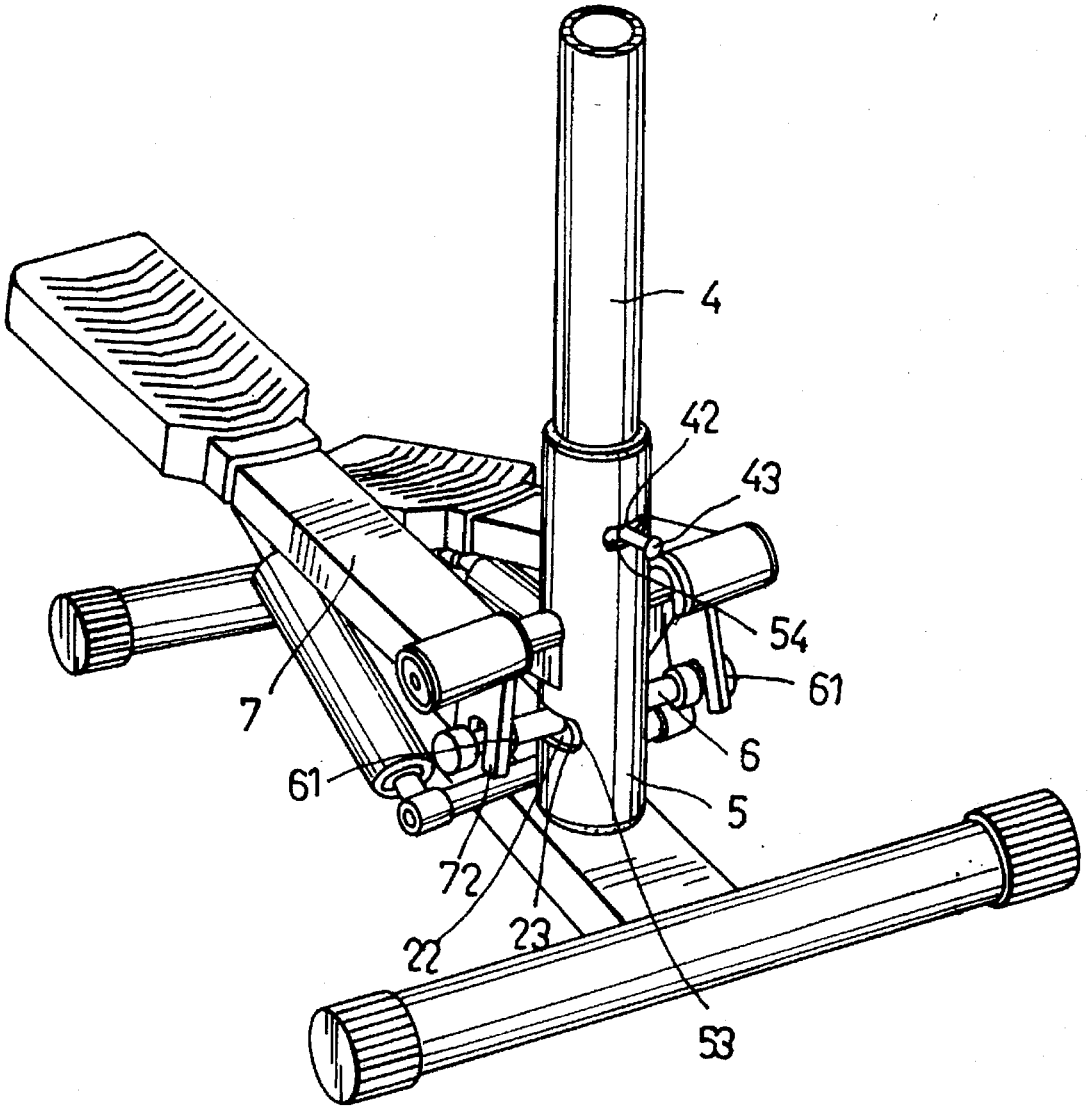
FIG. 3 is a perspective view of the preferred embodiment of the exerciser this invention to illustrate its assembly.

Referring to FIG. 3, the stepper 3 includes a pair of pedal arms 7. Each of the pedal arms 7 has a front end which is formed as a sleeve portion 71 that is sleeved on a respective one of the pivot arms 51 and that is fastened thereto by means of a fastening member 711. A transmitting member 72 is provided on the sleeve portion 71 and has a forked end which engages the annular groove 62 in the retaining member 61 on a respective one of the branches of the shaft 6. The stepper 3 further includes a pair of resistance cylinders 74. The resistance cylinders 74 are preferably hydraulic cylinders. Each resistance cylinder 74 has an end portion which connects the rear portion of a respective one of the pedal arms 7, and another end which is provided with a connecting sleeve 75 for engaging a respective one of the end portions 521 of the mounting rod 52 on the tubular sleeve 5.

The post 40 of the handle unit 4 has a top end which is formed with a pair of grip portions 41, and a bottom end which passes through the third packing ring 57 and which abuts against the second packing ring 56. The lower end of the post 40 is formed with a hole 42. A pin 43 extends into the hole 42 and protrudes radially from the post 40. The tubular sleeve 5 is further formed with a circumferentially extending slot 54 registering with the hole 42 to permit passage of the radial pin 43 therethrough. The slot 54 and the radial pin 43 cooperate to prevent the handle unit 4 from rotating along with the tubular sleeve 5 about the cylindrical body 22 and to limit rotation of the tubular sleeve 5 within the range of the circumferentially extending slot 54. The radial pin 43 also prevents upward movement of the handle unit 4.

When in use, as shown in FIG. 3, the tubular sleeve 5 is sleeved rotatably on the cylindrical body 22. The transmitting member 72 on each of the pedal arms 7 engages the retaining member 61 provided at the respective one of the branches of the shaft 6. The shaft 6 passes through the circumferentially extending opening 53 in the tubular sleeve 5 and the through hole 23 formed in the cylindrical body 22. The radial pin 43 is inserted into the hole 42 in the handle unit 4 and passes through the circumferentially extending slot 54. When the user steps on one of the pedal arms 7, the tubular sleeve 5 rotates about the cylindrical body 22, the rotation of which is limited by the circumferentially extending opening 53 and the circumferentially extending slot 54, thereby resulting in combined stepping and twisting functions.

Referring again to FIG. 4, the relative positions of the first packing ring 55, the second packing ring 56 and the third packing ring 57 are shown. The first packing ring 55 is provided between the tubular sleeve 5 and the cylindrical body 22. The second packing ring 56 is provided on top of the cylindrical body 22 and has the lower end of the post 40 of the handle unit 4 resting thereon. The third packing ring 57 is provided on top of the tubular sleeve 5 and is disposed between the tubular sleeve 5 and the post 40. By means of these packing rings, the post 40, the tubular sleeve 5 and the cylindrical body 22 can be suitably isolated from each other. Therefore, the friction and noise resulting from direct contact of these components can be significantly reduced, thereby prolonging the service life of the exerciser.

Referring to FIG. 5, the mounting portion 522 and the ball means 523 provided on the mounting rod 52 are shown. The ball means 523 is in rolling contact with the base 21 of the support frame 2 to facilitate rotation of the tubular sleeve 5 about the cylindrical body 22.

Accordingly, the exerciser of this invention is superior to the conventional exerciser described beforehand in view of its more simple and stable construction and ease of assembly.

With this invention thus explained, it is apparent that numerous modifications and variations can be made without departing from the scope and spirit of this invention. It is therefore intended that this invention be limited only as indicated in the appended claims.

I claim:

1. An exerciser with combined stepping and twisting functions, comprising:

a base having an upright cylindrical body fixed thereto, said cylindrical body being provided with a pair of radially extending and diametrically opposite branches;

a tubular sleeve sleeved rotatably on said cylindrical body and formed with a circumferentially extending opening to permit passage of said branches on said cylindrical body therethrough; and a stepper including: a pair of spaced pedal arms, each of which has a front end pivoted to said tubular sleeve, and a rear end; a pair of resistance cylinders, each of which interconnects said rear end of one of said pedal arms and said tubular sleeve; and a pair of transmitting members provided respectively on said front ends of said pedal arms, each of said transmitting members engaging a respective one of said branches on said cylindrical body;

whereby, when pressure is applied on one of said pedal arms, said one of said pedal arms causes said tubular sleeve to rotate about said cylindrical body, thereby resulting in the combined stepping and twisting functions.

2. The exerciser according to claim 1, wherein said cylindrical body on said base is formed with a diametrically extending through hole, said base further having a shaft passing through said through hole, said shaft having two end portions that serve as said branches on said cylindrical body.

3. The exerciser according to claim 1, wherein said front end of each of said pedal arms is provided with a sleeve portion, said tubular sleeve being formed with a pair of radially extending and diametrically opposite pivot arms, said sleeve portion of each of said pedal arms being sleeved on a respective one of said pivot arms.

4. The exerciser according to claim 1, wherein said tubular sleeve is provided with a horizontally disposed mounting rod having two end portions, each of said resistance cylinders engaging a respective one of said end portions of said mounting rod.

5. The exerciser according to claim 4, wherein said mounting rod of said tubular sleeve is provided with ball means in rolling contact with said base to facilitate rotation of said tubular sleeve about said cylindrical body.

6. The exerciser according to claim 1, wherein each of said transmitting members has a forked end, each of said branches being provided with a respective retaining member which is formed with an annular groove for engaging said forked end of the respective one of said transmitting members.

7. The exerciser according to claim 1, further comprising a packing ring sleeved on said cylindrical body and provided on top of said base, said packing ring having a ring portion between said cylindrical body and said tubular sleeve, and a flange portion between said base and said tubular sleeve, said tubular sleeve resting on said flange portion of said packing ring.

8. The exerciser according to claim 1, further comprising a handle unit having a post, said post having a top end formed with a pair of grip portions and a bottom end connected to said tubular sleeve.

9. The exerciser according to claim 8, wherein said bottom end of said post extends into said tubular sleeve and is provided with a radial pin, said tubular sleeve being formed with a circumferentially extending slot to permit passage of said pin therethrough.

10. The exerciser according to claim 9, further comprising a packing ring sleeved around said bottom end of said post, said packing ring having a ring portion between said bottom end of said post and said tubular sleeve, and a rim portion between said bottom end of said post and said cylindrical body.

11. The exerciser according to claim 9, further comprising a packing ring sleeved around said post, said packing ring having a ring portion between said post and said tubular sleeve, and a flange portion resting on top of said tubular sleeve.

* * * * *